United States Patent [19]

Kohsaka

[11] Patent Number: 4,584,732

[45] Date of Patent: Apr. 29, 1986

[54] WASHER/DEHYDRATER

[75] Inventor: Yoshio Kohsaka, Aichi, Japan

[73] Assignee: Kabushiki Kaisha Toshiba, Kawasaki, Japan

[21] Appl. No.: 695,827

[22] Filed: Jan. 28, 1985

[30] Foreign Application Priority Data

Jan. 30, 1984 [JP] Japan ..... 59-14730

[51] Int. Cl.[4] ..... D06F 23/04; D06F 33/02

[52] U.S. Cl. ..... 8/159; 68/12 R; 68/23 R; 68/174

[58] Field of Search ..... 8/159; 68/12 R, 23 R, 68/23.7, 174

[56] References Cited

U.S. PATENT DOCUMENTS 2,575,691 11/1951 Smith ..... 68/174 X
2,986,916 6/1961 Bochan .
3,220,227 11/1965 Schmitt ..... 68/12 R
3,246,182 4/1966 Hanchett ..... 68/12 R X

FOREIGN PATENT DOCUMENTS 13469 5/1961 Japan .
3420 2/1980 Japan .

*Primary Examiner*—Philip R. Coe
*Attorney, Agent, or Firm*—Cushman, Darby and Cushman

[57] ABSTRACT

A washer/dehydrater of the present invention comprises a washing tub and a vessel-like stirrer accommodated in a lower portion of the washing tub. The washing/dehydrating is performed through a washing step, a dehydrating step, a pre-rinsing step and a rinsing step. The washing and rinsing steps are performed by having the washing tub substantially stationary and rotating the stirrer forwards and backwards in a predetermined cycle period. The dehydrating step is performed by rotating the washing tub and stirrer in unison with each other in one direction at a high speed to thereby dehydrate the laundry. The pre-rinsing step is performed immediately before the rinsing step, which is performed after the dehydrating step, by rotating the stirrer forwards and backwards in a shorter cycle period than the aforesaid cycle period in the washing and rinsing steps.

10 Claims, 4 Drawing Figures

WASHER/DEHYDRATER

BACKGROUND OF THE INVENITON

This invention relates to a washer/dehydrater and a method of washing laundry, which permits high efficiency washing with forward and backward rotation of a vessel-like stirrer disposed in a lower portion of a washing tub used for washing and dehydration.

Heretofore, there has been a washer/dehydrater of the rotary blade type in which, during washing operation, water streams are provided in a washing tub with the rotation of a pulsator to provide for an increased cleaning efficiency. In this washer, however, the laundry is essentially washed by moving it with water streams. Therefore, the washing tub has to have a large volume. This means that with the present volume of the washing tub the amount of laundry that can be washed is small. In addition, when the amount of laundry is small with respect to the size of the washing tub, the laundry is subjected to excessively strong water streams so that it is over washed. On the other hand, when the amount of laundry is increased, the speed of the water streams is reduced, and this reduces the cleaning efficiency. Further, the contact between laundry and pulsator takes place at random and only in part of the laundry. For this reason, it is impossible to expect rubbing washing effect for the entire laundry. In some cases, the laundry is partly damaged.

Recently, there has been proposed a washer of a novel type which does not have a pulsator, but the entire washing tub is rotated to produce a speed difference between the water and laundry so as to obtain a cleaning effect from the speed difference. This type of washer has a merit that it will not cause damage to the laundry. However, the speed difference between the laundry and water is low, and the movement of laundry is simple, so that the cleaning efficiency is low.

Further in any of the above washers during the dehydration, the laundry experiencing strong centrifugal forces due to the rotation of the washing tub at a high speed is strongly urged against the inner wall of the washing tub, so that it will remain stuck to the tub wall and cannot be readily separated therefrom even after a subsequent rinsing operation, resulting in a prolonged washing time.

SUMMARY OF THE INVENTION

The present invention has been intended in the light of the above situation, and its object is to provide a washer/dehydrater and a method of washing/dehydrating, which eliminates damage to the laundry and permits a higher cleaning efficiency than in the prior art without rotation of a pulsator or the whole washing tub, accommodates an increased amount of laundry at one time, causes the range of the amount of laundry in which proper washing effect can be ensured to be wide, and prevents locking of the stirrer after dehydration with a sufficient rinsing effect.

To attain the above object of the invention, the washer/dehydrater has a washing tub and a vessel-like stirrer accommodated in a lower portion of the washing tub and washing/dehydrating is performed through a washing step, a dehydrating step, a pre-rinsing step and a rinsing step. The washing and rinsing steps are performed by having the washing tub substantially stationary and rotating the stirrer forwards for a predetermined time and backwards of the predetermined time to thereby clean the laundry mainly with a combined effect of the friction of the laundry against the inner peripheral wall of the stirrer and the frictional forces received by the laundry from the inner peripheral wall of an upper portion of the washing tub. The dehydrating step is performed by rotating the washing tub and stirrer in unison with each other in one direction at a high speed to thereby dehydrate the laundry. The pre-rinsing step is performed immediately before the rinsing step, which is performed after the dehydrating step, by rotating the stirrer forwards for a shorter time than the predetermined time and backwards for the shorter time. According to the invention, the laundry can receive a frictional washing effect due to rubbing against the inner peripheral walls of the washing tub and stirrer and also due to rubbing between the different pieces of laundry. A rubbing washing effect also occurs as it receives forces from the washing tub wall in different directions. Further, the laundry can be quickly separated from the peripheral wall of the washing tub in an initial stage of a rinsing step, which is performed after dehydration.

DETAILED DESCRIPTION OF THE PREFERRED EMBODIMENT

Now, an embodiment of the washer/dehydrater according to the invention will be described in detail with reference to the accompanying drawings.

Figure 1:
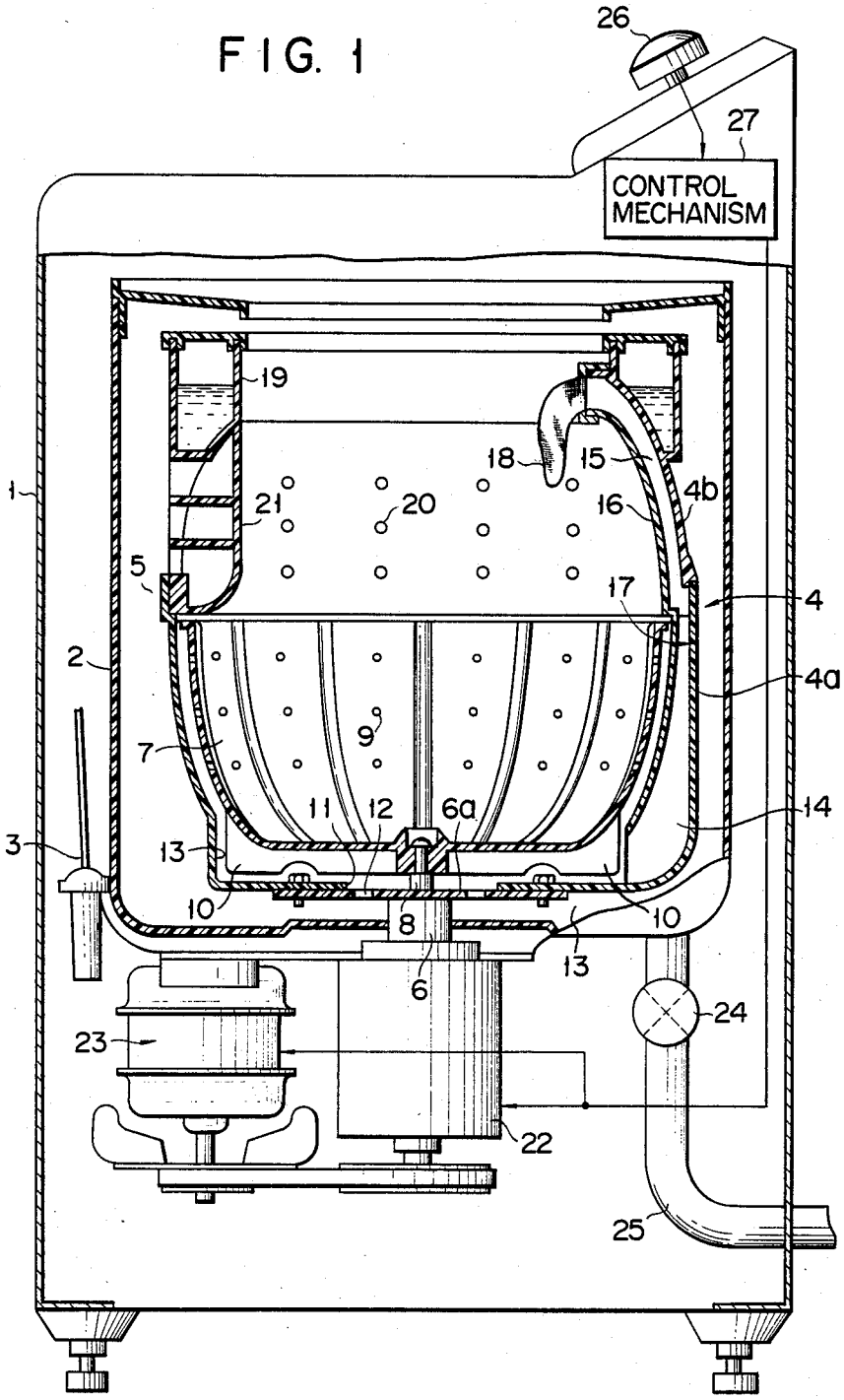
FIG. 1 is an elevational sectional view showing an embodiment of the washer/dehydrater according to the invention.

Referring to FIG. 1, there is shown the washer/dehydrater according to the invention, which comprises a housing 1 which accommodates a water tub 2 oscillatibly and elastically suspended by a hanging rod mechanism 3. A washing tub 4 is disposed in the washing tub 4. The washing tub 4 consists of a deep vessel open at the top, e.g., a cylinder with a bottom. In this embodiment, the washing tub consists of upper and lower halves **4*a* and 4*b*. The upper and lower halves 4*a* and 4*b* of the washing tub are coupled together by means of screws 5. The washing tub 4 is coaxially mounted on a hollow dehydration shaft 6 projecting from the bottom of the water tub 2**.

A stirrer 7, which is a comparatively shallow pot-like vessel, is rotatably disposed in a lower portion of the washing tub 4, i.e., in the lower half **4*a* thereof. The stirrer 7 is coaxially mounted on a washing shaft 8, which extends through and projects from the top of the dehydration shaft 6. The peripheral wall of the stirrer 7 has an uneven inner surface and a number of dehydration holes 9**.

The underside of the bottom of the stirrer 7 is provided with a plurality of radially separated blades 10, extending from the center up to substantially the edge. These blades 10 are accommodated in a recess 13 formed in the bottom of the lower half **4*a* of the washing tub 4**.

The bottom of the lower half 4a of the washing tub 4 has a substantially central opening. The washing shaft 8 extends through the opening 11 into the lower half 4a of the washing tub 4 and supports the stirrer 7. The dehydration shaft 6 has a flange 6a formed at the top. The flange 6a is secured to the lower half 4a of the washing tub to close the opening 11. The flange 6a has a plurality of water passage holes 12, which communicate the interior of the lower half 4a of the washing tub 4 and a space defined between the water tub 2 and lower half 4a.

The washing tub 4 has a water guide 17, which extends substantially vertical from the recess 13 in the lower half 4a up to the top of the upper half 4b to lead water from the recess 13 into the upper half 4b. More specifically, the water guide 17 is constituted by a first groove 14 formed in the inner peripheral wall of the lower half 4a and having the lower end open to the recess 13 and the upper end open at the top of the lower half 4a, a second groove 15 formed in the upper half 4b and having the lower end communicating with the first groove and the upper end inwardly bent at the top of the upper half 4b, and a cover 16 closing the open side of the first and second grooves 14 and 15 facing the interior of the washing tub 4. A filter 18, consisting of a net sack for catching lint is fitted on the upper end of the water guide 17.

A liquid-sealed balance ring 19 is provided on the top of the outer periphery of the washing tub 4 for balancing the tub 4 when the tub 4 is rotated at a high speed during dehydration. The peripheral wall of the upper tub 4b has a number of dehydration holes 20 and a vertically extending ridge 21.

Reference numeral 22 designates a drive force control mechanism, which includes a speed reduction mechanism, a clutch mechanism, and a brake mechanism. During washing and rinsing, the mechanism 22 holds the washing tub 4 stationary while transmitting the torque of a motor 23 to the washing shaft 8 such that the rotational direction thereof is reversed for every predetermined period of time. During dehydration, it transmits the torque of the motor 23 to the dehydration shaft 6 and washing shaft 8 simultaneously to cause high speed rotation of the washing tub 4 and stirrer 7 in one direction.

A draining hose 25 is connected to the bottom of the water tub 2 and is led to the outside of the housing 1. A draining valve 24 is provided on a portion of the hose 25 inside the housing 1.

A timer 26 is provided on the rear edge of the top of the housing 1. The operation of the washer/dehydrater, from the first step of washing till the last step of dehydration, is automatically controlled according to the predetermined term of each step by the timer 26. The timer 26 is connected to a control mechanism 27 which is accommodated in an upper portion of the housing 1. The control mechanism 27 is connected to the motor 23 and drive force control mechanism 22 and effects the control of the driving of the motor 23 and selection of the content of control of the drive force control mechanism 22 according to instructions from the timer 26.

Figure 2:
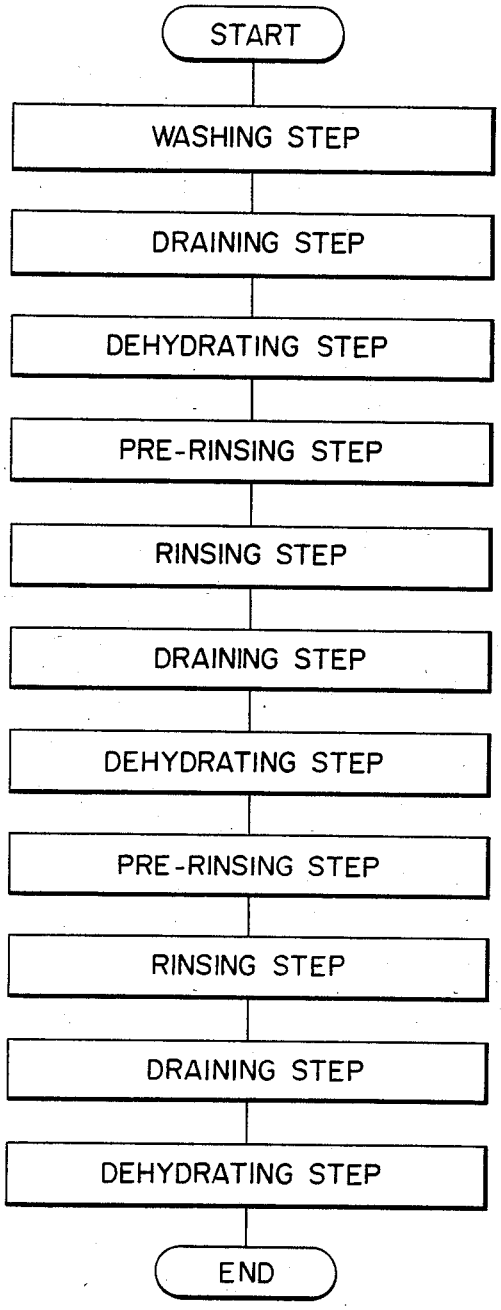
FIG. 2 is a flow chart illustrating the overall washing operation of the embodiment of the washer/dehydrater.

FIG. 2 shows the sequence of steps of the operation of this embodiment of the washer/dehydrater controlled by the timer 26. As seen from the Figure, in this embodiment a pre-rinsing step is executed immediately before each rinsing step. The pre-rinsing step constitutes a feature of the invention.

Figure 3:
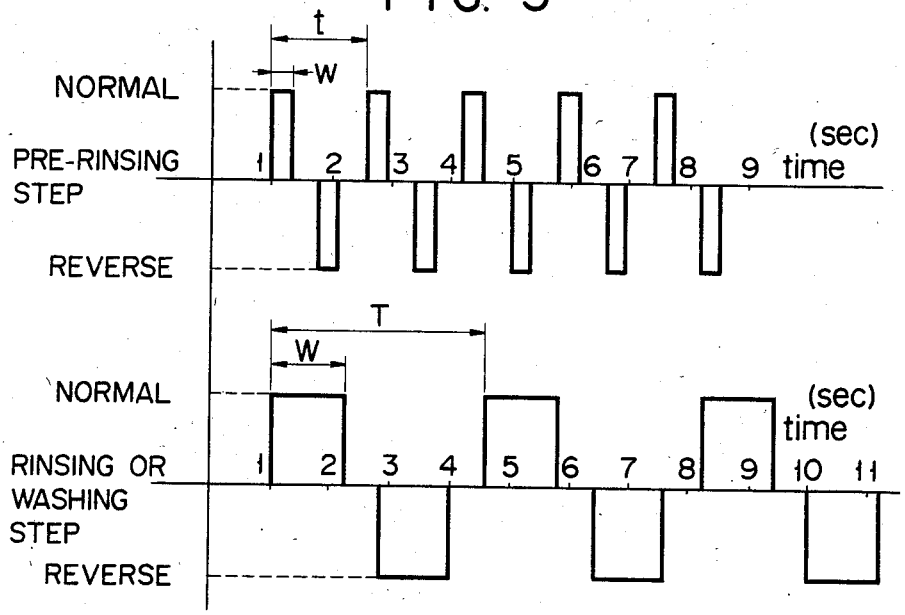
FIG. 3 is a time chart illustrating the energization of a motor in a pre-rinsing step and a rinsing step.

FIG. 3 shows the manner, in which the driving of the motor 23 is controlled by the control mechanism 27 in the pre-rinsing and rinsing steps. As seen from the Figure, the stirrer 7 is repeatedly rotated forwards and backwards in a short cycle period t and a short pulse width w in the pre-rinsing step. In the rinsing step, the stirrer 7 is repeatedly rotated forwards and backwards in a longer cycle period T and a longer pulse width W than the period t and a pulse width w, respectively. The period T and pulse width W are, respectively, the same as the period and pulse width of forward and backward rotation cycle of the stirrer 7 in the washing step. In this embodiment, the number of rotations of the stirrer 7 until the reversal of the direction of rotation is set to be less than 1, preferably about $\frac{3}{4}$, in the short cycle period t and to 2 to 4 in the long cycle period T.

To realize the short cycle period t, the control mechanism 27 causes 10 recurrent cycles of energizing the motor 23 for rotation in one direction for approximately 0.3 second (short pulse width w), then having the motor de-energized for approximately 0.5 second, then energizing the motor for rotation in the opposite direction for approximately 0.3 second and then having the motor de-energized for approximately 0.5 second. On the other hand, to realize the long cycle period T the control mechanism 27 causes a predetermined number of recurrent cycles of energizing the motor 23 for rotation in one direction for approximately 1.2 seconds (long pulse width W), then having the motor de-energized for approximately 0.6 second, then energizing the motor for rotation in the opposite direction for approximately 1.2 seconds and then having the motor de-energized for approximately 0.6 second.

The operation of the washer/dehydrater having the above construction will now be described.

In the washing step, the laundry is put into the washer/dehydrater and then water is supplied to the water tub 2, i.e., washing tub 4, in an amount substantially equal to the amount of the prior art rotary blade type washer. In this step, only the stirrer 7 is repeatedly rotated forwards and backwards with the washing tub 4 held substantially locked by the brake mechanism to prevent rotation. In this embodiment, the rotational speed of the stirrer 7 is set to be in a range of 120 to 180 rpm, and the direction of rotation is reversed for every 2 to 4 rotations as noted above.

In this washing operation, the laundry is caused to touch the peripheral wall of the stirrer 7 and the peripheral wall of an upper portion of the washing tub 4, i.e., upper half 4b thereof, with alternate forward and backward rotations of the stirrer 7. The lower portion of the laundry is thus given a torque by its frictional contact with the stirrer 7, while its upper portion is given a restraining force by its frictional contact with the upper half 4b of the washing tub. With frictional forces exerted to it in different directions at the same time, the laundry is twisted and/or pressed. The pressing action takes place repeatedly with the reversal of the direction of rotation of the stirrer 7. At the same time, the laundry is urged against the peripheral wall of the stirrer 7 by the centrifugal forces received and receives the inward reaction force from the peripheral wall of the upper half 4b of the washing tub. Thus, some effort is made to turn the laundry upside down. In this way, the laundry is subjected to very complicated motion.

The laundry thus receives the rubbing and washing effects by the action of the various pieces of laundry due to the complicated motion noted above and also its friction with the peripheral walls of the upper half 4b of the washing tub 4 and stirrer 7. Meanwhile, it receives a sort of rubbing washing effect by its twisting and repeated pressure application. In this way, the laundry is washed.

Figure 4:
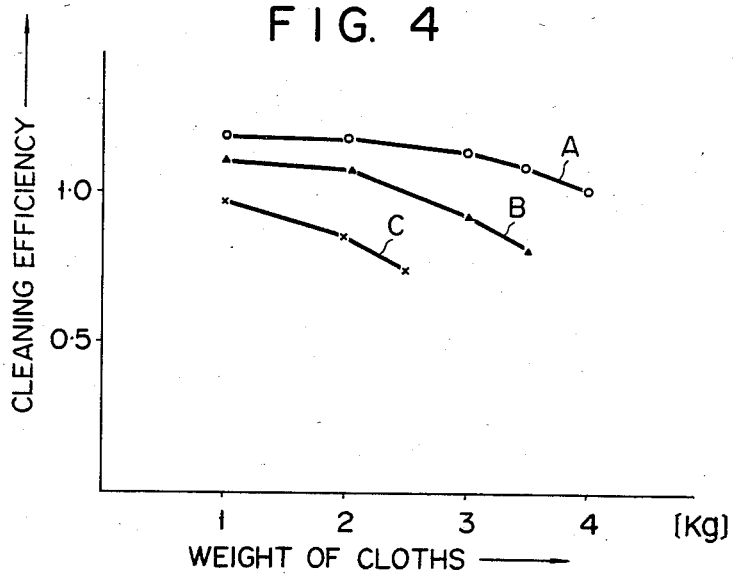
FIG. 4 is a graph showing various cleaning efficiency characteristics.

FIG. 4 shows results of experiments which verify that the washing method as described above has excellent cleaning effects. Curve A in FIG. 4 represents cleaning efficiency obtained with this embodiment. Curve B represents cleaning efficiency of the prior art pulsator type washer. Curve C represents cleaning efficiency the entire washing tub rotation type washer that has been contemplated prior to the invention. As is obvious from the graph, with the embodiment of the invention, very high cleaning efficiency can be obtained compared to the other systems.

Since the laundry is moved in the washing tub 4 by its frictional contact with the peripheral walls of the upper half 4b of the washing tub 4 and stirrer 7, as mentioned before, the frictional forces are increased with the increase in the amount of laundry washed. Thus, increasing the amount of laundry to be washed will neither hinder the easiness of movement of the laundry nor the cleaning efficiency. When the amount of laundry charged is small, on the other hand, the frequency of its contact with the peripheral wall of the stirrer 7 is reduced, and the frictional forces exerted are extremely reduced. Consequently, the laundry is moved and washed mainly by the water streams, produced inside the entire washing tub 4 by the constant speed rotation of the stirrer 7, having a considerably large surface area. Thus, unlike the prior art pulsator type washer, excessively strong water streams in the washing tub 4 and excessive washing will not result even when the amount of laundry to be washed is small. That is, the proper extent of washing can be ensured irrespective of the amount of laundry to be washed. This means that the amount of laundry, with which the proper cleaning effect can be obtained, can be larger with the washer/-dehydrater according to the invention than that of the prior art washer.

After the washing step, a draining step is executed. In the draining step, the draining valve 24 is opened to drain water in the water tub 2. After the draining step, a dehydrating step is executed.

The dehydrating step will now be described in detail. In this step, the draining valve 24 is opened to drain water in the water tub 4. Then, a clutch mechanism or the like (not shown) is operated to rotate the washing tub 4 and stirrer 7 in unison with each other and in one direction at a high speed. Water is thus extracted from the laundry by the strong centrifugal forces thus produced. The extracted water is discharged through the dehydration holes 9 in the stirrer 7 and dehydration holes 20 in the upper half 4b of the washing tub 4 to the outside of the washing tub 4, i.e., into the water tub 2, and thence to the outside of the housing 1 through the draining hose 25. The draining valve 24 provided on the hose 25 is held open at this time.

In the dehydrating step, the laundry that experiences strong centrifugal forces as noted above is forced against the inner peripheral walls of the stirrer 7 and the upper half 4b of the washing tub 4. Therefore, it is likely that the laundry remains stuck to and cannot be readily separated from the inner peripheral walls in a rinsing step that is performed after the dehydrating step. This will lead to insufficient rising or a long rinsing time. Moreover, in a washer using the stirrer 7 as in this embodiment, the stirrer 7 will get out of rotational balance and be locked in an extreme case by the laundry remaining stuck to it. When such locking of the stirrer 7 results, the motor 23 has to provide a particular starting torque that can surpass such locking. Such a countermeasure against the locking of the stirrer will increase the price and weight of the washer.

In this connection, in this embodiment a pre-rinsing step is provided immediately before each rinsing step after the dehydrating step. In this pre-rinsing step, the stirrer 7 is rotated forwards and backwards in a shorter cycle period t than the cycle period T in the washing step. When the stirrer 7 is driven forwards and backwards in such a short cycle period t, even if laundry remains stuck to its inner peripheral wall, it will receive torque in the opposite direction soon after the start of its rotation in one direction and before it is locked. The locking of the stirrer 7 thus can be reliably prevented. As the stirrer 7 is repeatedly driven forwards and backwards at such a high frequency, the laundry remaining stuck to its inner surface experiences vibrations, which are effective to separate the laundry from the inner peripheral wall of the stirrer. As the laundry is joggled little by little in this way, a gap is gradually developed between the laundry and inner wall of the stirrer, and water enters the gap, so that the laundry is ultimately separated from the stirrer. Thus, in the subsequent regular rinsing step, the laundry is quickly separated from the stirrer inner wall. In the rinsing step, the laundry separated from the stirrer inner wall is thus properly rinsed in the washing tub 4 as in the washing step. It is thus possible to increase the efficiency of wringing the laundry.

Besides, the stirrer 7 can be driven smoothly without the possibility of locking. That is, the motor 23 need not provide particularly high starting torque, but an ordinary motor can be used, so that the price and weight of the washer can be reduced.

The above embodiment of the invention has been given for the purpose of illustration only and various changes and modifications thereof are possible without departing from the scope of the invention.

What is claimed is:

1. A method of washing/dehydrating laundry using a washer/dehydrater having a washing tub and a vessel-like stirrer accommodated in a lower portion of said washing tub comprising a washing step, a dehydrating step, a pre-rinsing step and a rinsing step, said washing and rinsing steps being performed by having said washing tub substantially stationary and rotating said stirrer forwards for a predetermined time and backwards for the predetermined time to thereby clean the laundry mainly with a combined effect of the friction of the laundry with the inner peripheral wall of said stirrer and frictional forces received by the laundry from the inner peripheral wall of an upper portion of said washing tub, said dehydrating step being performed by rotating said washing tub and stirrer in unison with each other in one direction at a high speed to thereby dehydrate the laundry, said pre-rinsing step being performed immediately before the rinsing step, performed after the dehydrating step, by rotating said stirrer forwards for a shorter time than the predetermined time and backwards for the shorter time.

2. The method of washing laundry according to claim 1, wherein said washing and rinsing steps are performed by rotating said stirrer forwards and backwards in a predetermined cycle period, and said pre-rinsing step is performed by rotating said stirrer forwards and backwards in a shorter cycle period than the aforesaid cycle period.

3. The method of washing laundry according to claim 2, wherein the number of rotations of said stirrer, until the reversal of the rotational direction thereof in said pre-rinsing step, is set to one or below.

4. The method of washing laundry according to claim 3, wherein the number of rotations of said stirrer, until the reversal of rotational direction thereof in said pre-rinsing step, is set substantially to $\frac{3}{4}$.

5. The method of washing according to claim 3, wherein the number of rotations of said stirrer, until the reversal of rotational direction thereof in said rinsing step, is set to 2 to 4.

6. A washer comprising:

a housing;

a water tub provided in said housing;

a washing tub rotatably provided in said water tub;

a vessel-like stirrer rotatably provided in a lower portion of said washing tub;

driving means for causing rotation of said washing tub and stirrer; and control means connected to said driving means for having said washing tub stationary while rotating said stirrer forwards for a predetermined time and backwards for the predetermined time in a washing step and a rinsing step, rotating said washing tub and stirrer in unison with each other in one direction at a high speed in a dehydrating step and rotating said stirrer forwards for a shorter time than the predetermined time and backwards for the shorter time in a pre-rinsing step performed immediately after said dehydrating step.

7. The washer according to claim 6, wherein said control means controls the drive means to rotate said stirrer forwards and backwards in a predetermined cycle period in the washing step and the rinsing step, and to rotate said stirrer forwards and backwards in a cycle period shorter than said predetermined cycle period in the pre-rinsing step.

8. The washer according to claim 7, wherein said control means controls said driving means such that the number of rotations of said stirrer, until the reversal of rotational direction thereof in said pre-rinsing step, is one or below.

9. The washer according to claim 7, wherein said control means controls said driving means such that the number of rotations of said stirrer, until the reversal of rotational direction thereof in said pre-rinsing step, is substantially $\frac{3}{4}$.

10. The washer according to claim 9, wherein said control means controls said driving means such that the number of rotations of said stirrer, until the reversal of rotational direction thereof in said rinsing step, is 2 to 4.

* * * * *